US006015312A

United States Patent [19]

Escane

[11] Patent Number: 6,015,312

[45] Date of Patent: Jan. 18, 2000

[54] CONNECTOR UNIT

[75] Inventor: Richard Escane, Orpington, United Kingdom

[73] Assignee: A.C. Egerton Limited, Kent, United Kingdom

[21] Appl. No.: 08/761,162

[22] Filed: Dec. 6, 1996

[30] Foreign Application Priority Data

| | | | |
|---|---|---|---|
| Dec. 8, 1995 | [GB] | United Kingdom | 9525128 |
| May 17, 1996 | [GB] | United Kingdom | 9610396 |

[51] Int. Cl.[7] ..... H01R 4/24

[52] U.S. Cl. ..... 439/417

[58] Field of Search ..... 439/403, 417, 439/922

[56] References Cited

U.S. PATENT DOCUMENTS

| | | | |
|---|---|---|---|
| 4,688,865 | 8/1987 | Kelly | 439/922 X |
| 4,846,735 | 7/1989 | Teichler et al. | 439/922 X |
| 5,181,861 | 1/1993 | Graver, Jr. et al. | 439/578 |
| 5,302,137 | 4/1994 | Suffi | 439/403 OR |
| 5,449,299 | 9/1995 | Shimirak et al. | 439/417 OR |
| 5,451,170 | 9/1995 | Suffi | 439/922 X |

FOREIGN PATENT DOCUMENTS

| | | |
|---|---|---|
| 0 315 345 A2 | 5/1989 | European Pat. Off. . |
| 0542164A2 | 5/1993 | European Pat. Off. . |
| 0644613A1 | 3/1995 | France . |
| 0646987A1 | 4/1995 | France . |
| 412939 | 7/1934 | United Kingdom . |
| 668037 | 3/1952 | United Kingdom . |
| WO 89/08337 | 8/1989 | WIPO . |

*Primary Examiner*—Paula Bradley
*Assistant Examiner*—Daniel Wittels
*Attorney, Agent, or Firm*—Wolf, Greenfield & Sacks, P.C.

[57] ABSTRACT

A connector unit is described comprising a base unit 12 and a connector module 10, the base unit 12 comprising a walls 14 for accepting the connector module 10, the connector module 10 including at least one IDC connector 36 for making electrical connection with a wire 48 and channels 26 for retention of a wire 48, wherein the connector module 10 is such that insertion thereof into the base unit 12 causes the IDC 36 connector to move relative to the channels 26 thereby to make electrical connection between the IDC connector 36 and a wire 48 in the channels 26.

16 Claims, 9 Drawing Sheets

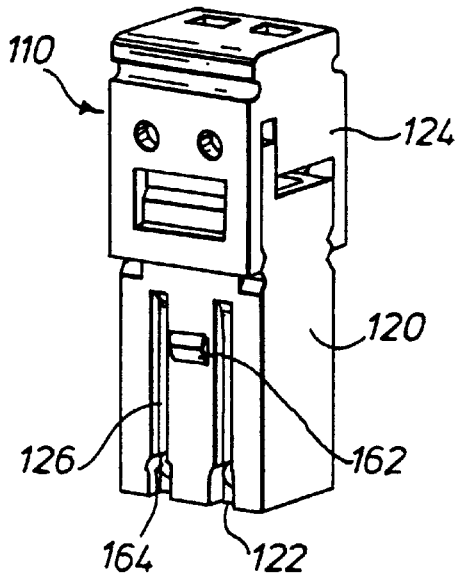
Fig.6a.
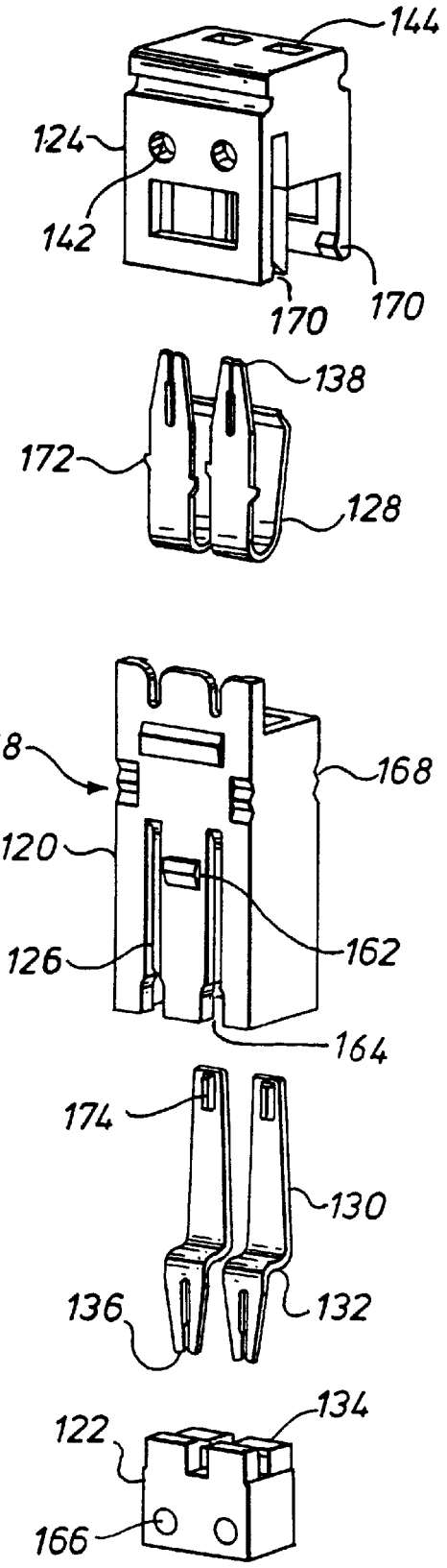
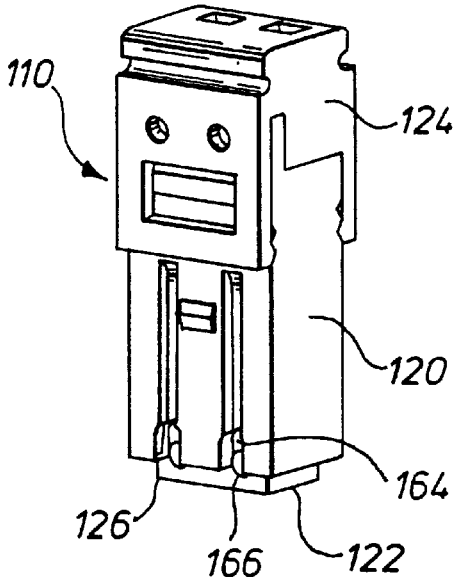
Fig.6b.
Fig.7.

CONNECTOR UNIT

BACKGROUND OF THE INVENTION

1. Field of the Invention

The present invention relates to a connector unit, particularly but not exclusively for use in telecommunications.

2. Description of the Prior Art

In a telecommunications context, it is often necessary to connect large numbers of "jumper pairs" to corresponding "exchange pairs". Exchange pairs emanate from the telephone exchange, and jumper pairs link the exchange pairs (eventually) to a consumer unit. In general, exchange pairs are connected to a connector module at the time of installing the telephone network, whereas jumper pairs may be connected, disconnected and reconnected several times as the consumer needs change.

There therefore exists a need for reliable interconnection of exchange and jumper pairs. It should be possible to disconnect and reconnect the exchange pairs, for example in the case of a fault, but it is not necessary that this should be feasible on a repeated basis.

EP-A-0315345 discloses an electrical connector apparently suitable for use in this context. The connector uses insulation displacement contacts (IDC), which are contacts having a blade portion at the tip suitable for piercing the plastics insulation of a wire and making electrical contact with the metallic conductor therewithin. Such IDC connectors are well known in this field.

The designs illustrated in EP-A-0315345 show an IDC connector having two blade portions, one for interconnection with the jumper wire and one for interconnection with the exchange wire. A movable carrier is disclosed which holds the jumper wire and can be forced downwards to bring the enclosed jumper wire into conjunction with the IDC connector. Doing so forces the IDC connector to travel downward into connection with an exchange wire prepositioned in an internal channel within the connector unit.

No consideration is apparently given in this prior art design to disconnection of the exchange wire, and it seems that this would be an extremely troublesome operation. In addition, the connector body disclosed has many moving parts, most of which have an intricate shape that will be difficult to manufacture to the required tolerance.

SUMMARY OF THE INVENTION

The present invention therefore provides a connector apparatus comprising a base unit and a connector module;

the base unit comprising a module receiving means for accepting the connector module;

the connector module including at least one IDC connector for making electrical connection with a wire and a wire receiving means for retention of a wire;

wherein the connector module is such that insertion thereof into the base unit causes the IDC connector to move relative to the wire receiving means thereby to make electrical connection between the IDC connector and a wire in the wire receiving means.

Preferably, the connector module comprises a head part and a body part, with a bore extending through both and containing the IDC connector, such that force applied to the head part such as to engage the connector unit within the base unit causes the head part to move relative to the body part and hence to move the IDC connector relative thereto.

The wire receiving means can be a bore, or a channel leading to a bore, into which bore or channel the IDC connector can extend. Preferably, the IDC connector so extends only in certain relative positions of the head part and body part, when the connector module is constructed thereof.

Preferably, the connector apparatus is such that tension on a wire engaged with the IDC connector causes the connector module to be removed from the base unit. This provides a particularly straightforward method of removing the exchange wire, such as for reconfiguration purposes.

The wire mentioned above can be an exchange wire of a telecommunications system.

In its second aspect, the present invention therefore provides a connector unit comprising a plug body including a main body part and a head part, the main body and the head part being capable of mutual longitudinal displacement, and at least one channel formed on an external surface of at least the head part for receiving a wire, and at least one contact member having a portion within the main body part and a portion within the head part, and an insulation displacing tip;

wherein relative displacement of the main body and head parts from a first position to a second position causes the insulation displacing tip to move relative to the channel from a position in which electrical contact will not be made with a wire in the channel to one in which electrical contact will be made between a wire in the channel and the contact member, by the insulation displacing tip.

Preferably, there are two channels, and two connectors, one per channel. Thus, contact will be made with a pair of wires.

Preferably, in the first position, the insulation displacing tip does not substantially project into the channel, and in the second position it does substantially project into the channel.

More preferably, the connector unit is associated with a base unit into which the plug body is insertable, thereby to at least partly cover the channel. More preferably, insertion of the plug body into the base unit entirely encloses the head part, still more preferably partly covers the main body.

It is also preferred if the action of pressing the unit into the base causes mutual displacement of the head portion and main body portion thereby to cause electrical contact to be made between the connector and a wire within the channel.

It is preferred if the channel runs over the head portion and partly onto the main body.

A particularly simple construction is obtained if (according to a still yet preferred form) the main body and the head slide relatively along the contact member.

BRIEF DESCRIPTION OF THE DRAWINGS

Embodiments of the present invention will now be described by way of example, with reference to the accompanying Figures, in which:

FIGS. 6*a* and 6*b* are views of a single connector according to the first embodiment, ready to accept a jumper wire and in the form after it has accepted a jumper wire (not shown), respectively;

FIG. 7 is an exploded view of the connector of FIGS. 6*a* and 6*b*.

DETAILED DESCRIPTION OF THE PREFERRED EMBODIMENTS

Figure 1:
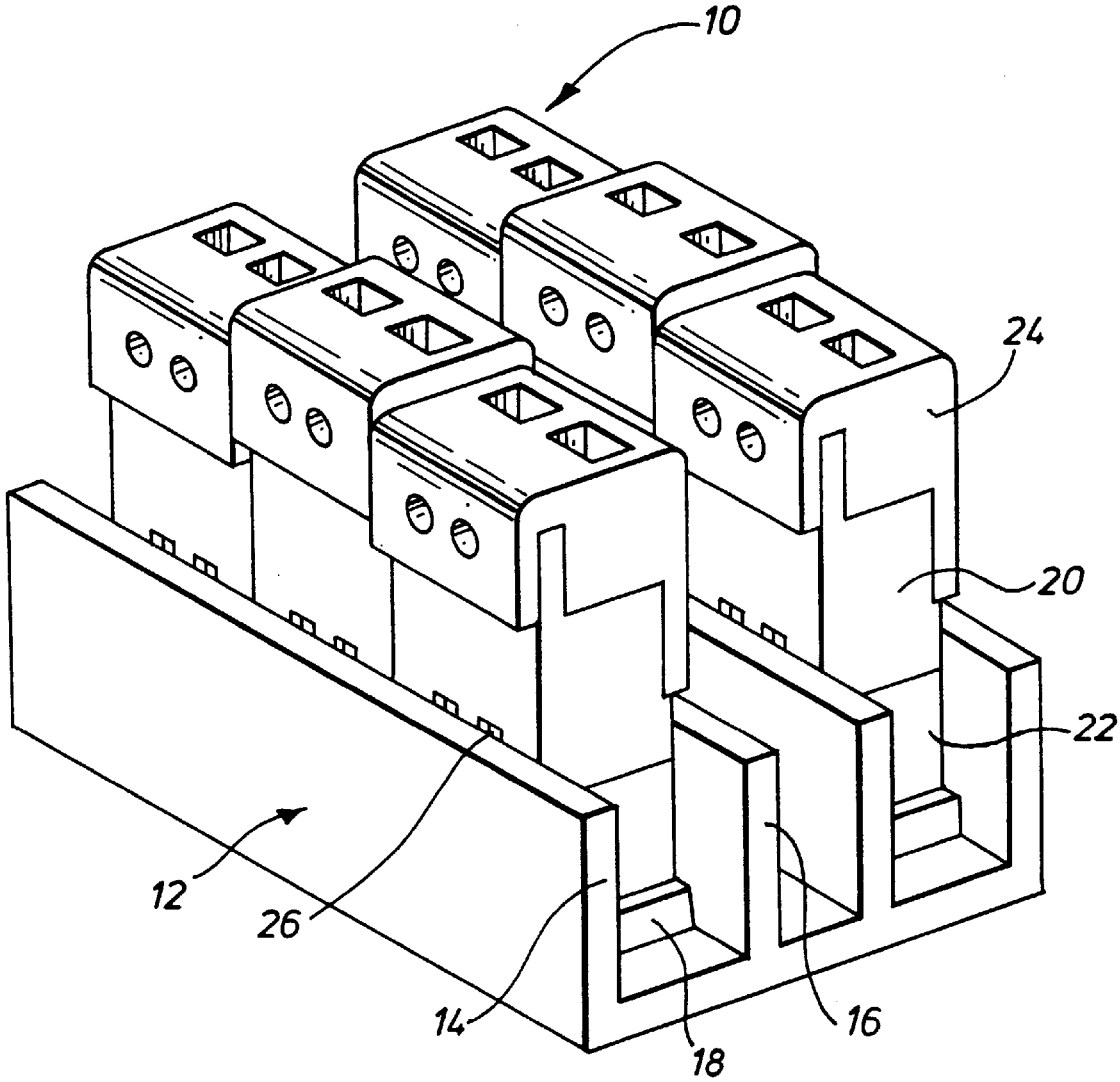
FIG. 1 is a perspective view of a group of connectors according to the first embodiment of the present invention.

The first embodiment of the invention is shown in FIGS. 1 to 4. FIG. 1 shows an array of six connector units 10 according to the first embodiment. The connectors 10 are supported in a base unit 12 in two rows of three connectors. The connectors 10 are generally upright in configuration and are held in the base unit 12 between pairs of opposing walls 14,16. Lateral displacement between the walls 14,16 is prevented by an end stop 18.

The connectors 10 are constructed from a main body part 20, a head part 22 at one end of the main body part 20, and a cap 24 at the other end. When the connector 10 is installed in the base 12, the head part 22 is enclosed between the opposed walls 14,16, the main body part 20 projects out from between the walls 14,16 and the cap 24 is presented outermost.

A pair of channels 26 are formed in the outside surface of the main body 20 and head part 22. These run substantially parallel from approximately the mid portion of the main body 20, along the connector portion 10 to the end of the head part 22, around the end of the head part 22, and then into a small recess (not visible in FIG. 1) at the rear face of the head 22. The channels 26 can be seen more clearly in later figures, but are just visible in FIG. 1 above the top of wall 14. Thus, the channels are accessible whilst the connector 10 is installed in the base unit 12.

Figure 2A:
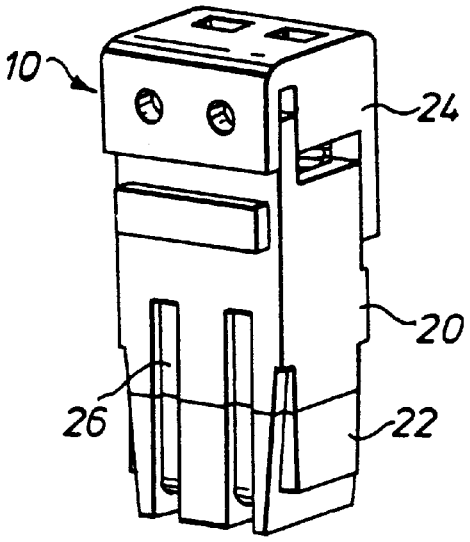
FIG. 2*a* is a view of a single connector according to the first embodiment of the present invention, ready to accept a jumper wire.
Figure 2B:
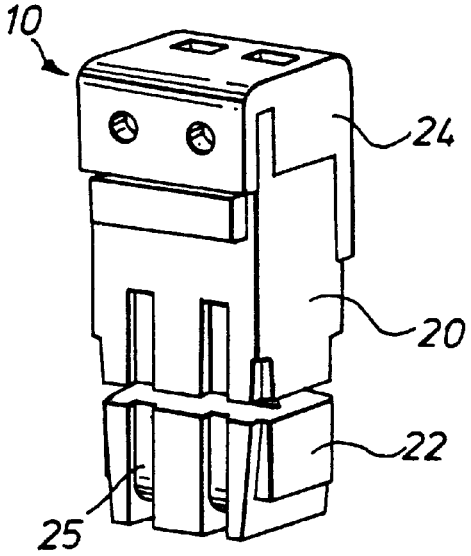
FIG. 2*b* is the connector of FIG. 2*a*, in the form after it has accepted a jumper wire (not shown)

FIGS. 2*a* and 2*b* show the connector unit 10 away from the base unit 12. In FIG. 2*a*, the channels 26 are visible insofar as they run along the front face of the connector 10 to the end of the head part 22.

In FIG. 2*a*, the cap 24 has been raised relative to the main body 20, thereby to separate the two parts slightly. Thus, the connector 10 is then in a position to accept a jumper pair.

In FIG. 2*b*, the head part 22 has been moved longitudinally slightly away from the main body 20, ready for the connector to accept an exchange pair.

Figure 3:
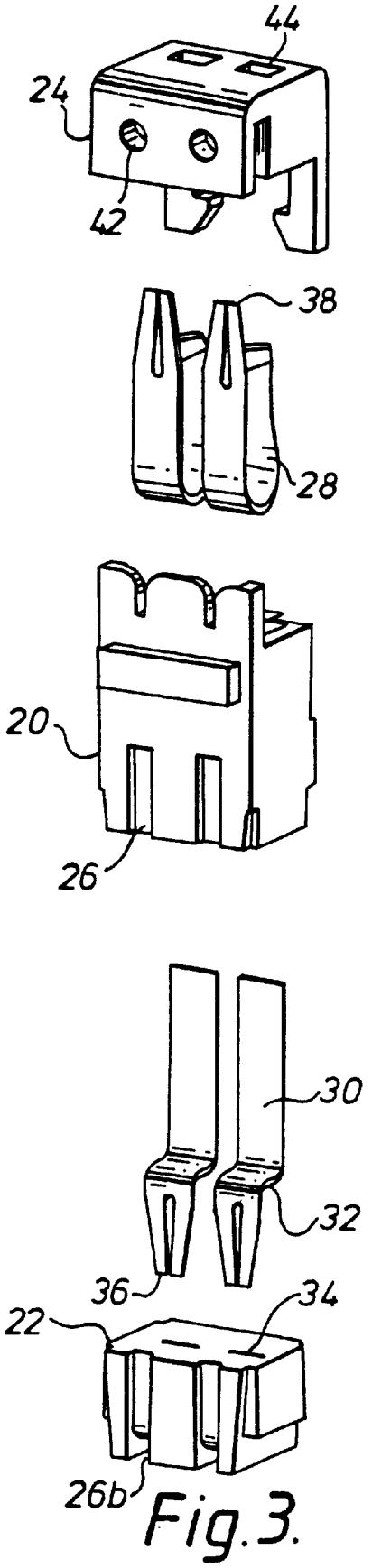
FIG. 3 is an exploded view of the connector of FIGS. 2*a* and 2*b;*

FIG. 3 shows the connector 10 in an exploded form. It can now be seen that the main body part is substantially hollow and that within the connector 10 are a pair of jumper IDC contacts 28 and a pair of exchange IDC contacts 30.

The exchange contacts 30 are generally elongate and lie within the main body 20 against a rear internal wall thereof. They emanate from the base of the main body 20, have a short dog-leg 32 toward the central axis of the connector 10 and enter the head part 22 through centrally located slots 34. The contacts 30 terminate within the head part 22 at an IDC tip 36. The length of the IDC tip is sufficient to project a substantial distance into the channel 26*b* running across the tip of the head part 22, when the head part 22 is snug against the main body part 20. When the head part 22 is slightly separated from the body part 20 in the form shown in FIG. 2*b*, the IDC connectors 36 do not so project.

The jumper connectors 28 are formed in a resilient substantially U-shape with an IDC connector 38 at one tip. The U-shaped contacts 28 lie within the internal space of the main body part 20 and their resilience ensures that the side of the U with the IDC tip 38 rests against a front internal wall of the body part 20 (opposed to that against which the exchange contact 30 rests), whilst the other tip of the connector lies resiliently abutting the exchange contact 30.

The length of the IDC connector 38 is sufficient to project into a slot 40 (not visible in FIG. 3) in the cap 24. Intersecting with the slot 40 are a pair of cylindrical recesses 42 into which a jumper pair can be inserted.

Thus, when a cap 24 is in the raised position shown in FIG. 2*a*, a pair of jumper wires can be inserted into the recesses 42, whereupon downward movement of the cap 24 towards the main body 20 causes the jumper wires to be pressed into the IDC contacts 38, forming a connection.

At the top of the cap 24 are a pair of test access openings 44. These lie directly above the point of contact between the jumper contacts 28 and the exchange contacts 30. Thus, a probe can be inserted to make electrical contact with one or both of these contacts 28,30, or to separate the contacts 28,30.

The operation of the connector 10 will now be described with reference to FIGS. 4*a* to 4*f*.

Figure 4A:
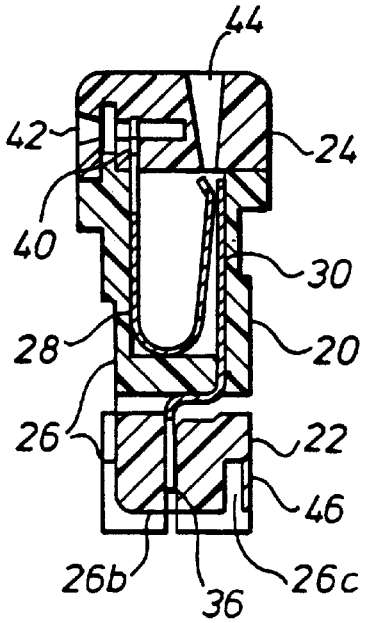
FIGS. 4*a* to 4*f* are sequential illustrations showing the action of connecting exchange and jumper wires to the connector of FIGS. 2 and 3, shown in section.

FIG. 4*a* shows the connector 10 ready for installation. The head part 22 is slightly separated from the main body part 20, meaning that the IDC tip 36 of the exchange contact 30 does not project into the recess 26*b* running beneath the head part 22. In this sectional figure, it can now be seen that the channel 26*b* ends at the rear face of the head 22 in a recess 26*c* bounded by a relatively thin wall 46.

Figure 4B:
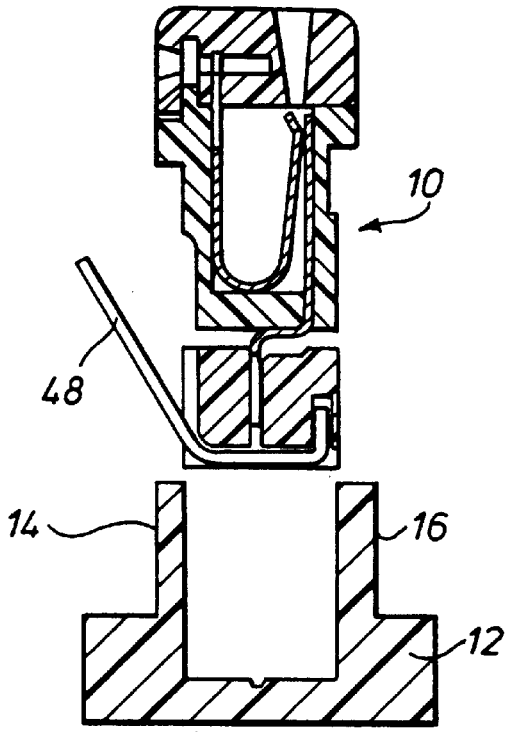
Figure 4C:
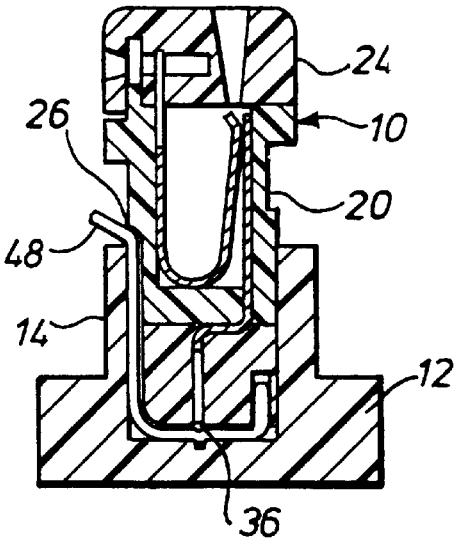
Figure 4D:
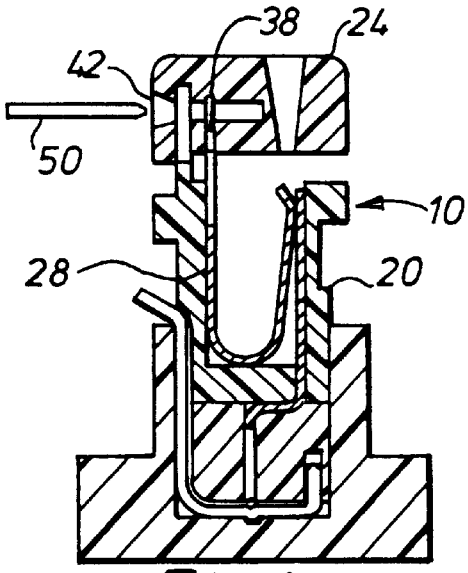

In FIG. 4*b*, the connector unit 10 is shown just prior to installation. The tip of an exchange wire 48 has been inserted into the recess 26*c* and laid along the channel 26*b*. The connector unit 10 is then positioned over the base unit 12 ready to be placed between the opposed walls 14,16. As shown in FIG. 4*c* the connector unit 10 is then pressed firmly downward into position between the two walls 14,16. In this process, the main body part 20 and head part 22 are compressed together, and the IDC tip 36 of the exchange connector 30 is pushed into the channel 26*b* such that it substantially projects thereinto. Hence, contact is made between the IDC tip 36 and the exchange wire 48.

In the installed configuration shown in FIG. 4*c*, the exchange wire 48 then trails from the connector unit 10 from the part of the channel 26 that is visible above the wall 14.

To instal the jumper pairs, the cap 24 is lifted slightly from the body 20, and a jumper wire 50 inserted into the recess 42. Once the jumper wire 50 is fully home, the cap 24 is then pressed downward towards the main body 20, and this causes the IDC tip 38 of the jumper contact 28 to make contact with the jumper wire within the recess 42.

Figure 4E:
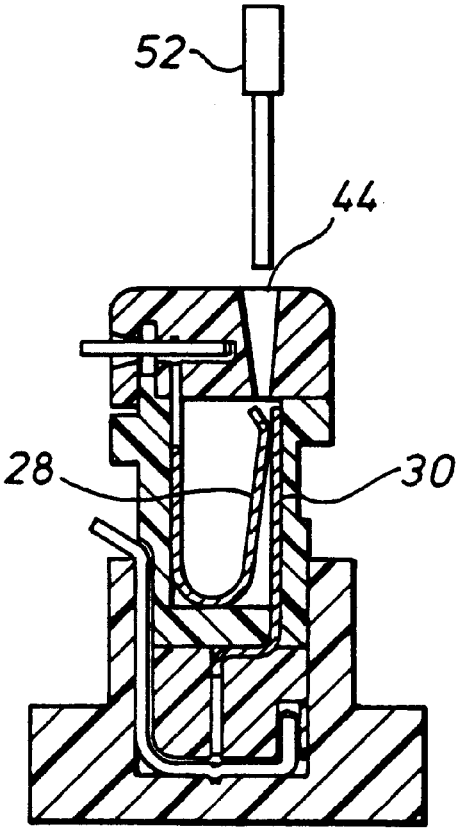
Figure 4F:
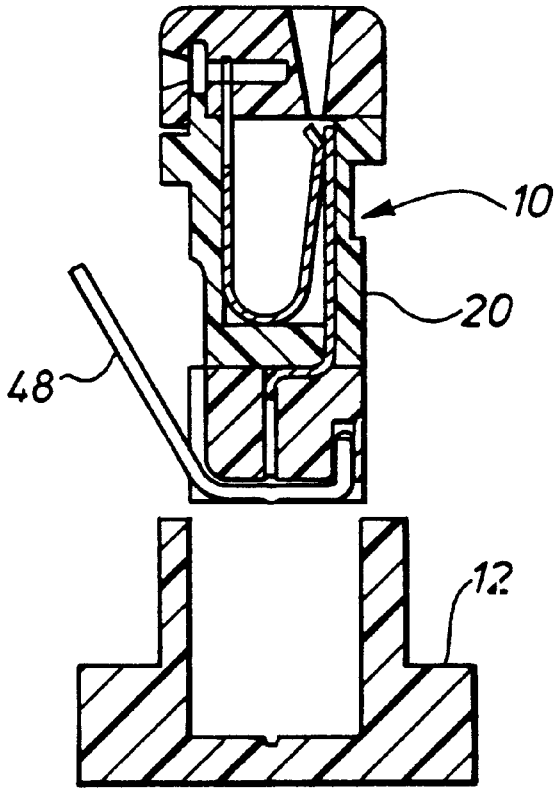

Once both wires are installed, as shown in FIG. 4*e*, a test probe 52 can be inserted in the test access opening 44, where it can contact the jumper contact 28 and exchange contact 30. Such test probes are known, and include insulating probes which serve to separate the two contacts, solid conducting probes which serve to make electrical contact with both contacts 28,30 simultaneously, and more specialised probes which both separate the contact 28,30, and provide electrical contact with each of the contact 28,30 individually.

To remove the exchange wire 48, for example in the case of incorrect installation, the main body 20 of the connector 10 is gripped and pulled upwards out of the base unit 12. This then allows the exchange wire 48 to be pulled away from the connector unit 10.

The second embodiment is shown in FIGS. 5 to 8. The general construction and operation of the second embodiment bears a close similarity to that of the first, and similar reference numerals have been used to denote this, where possible.

Figure 5:
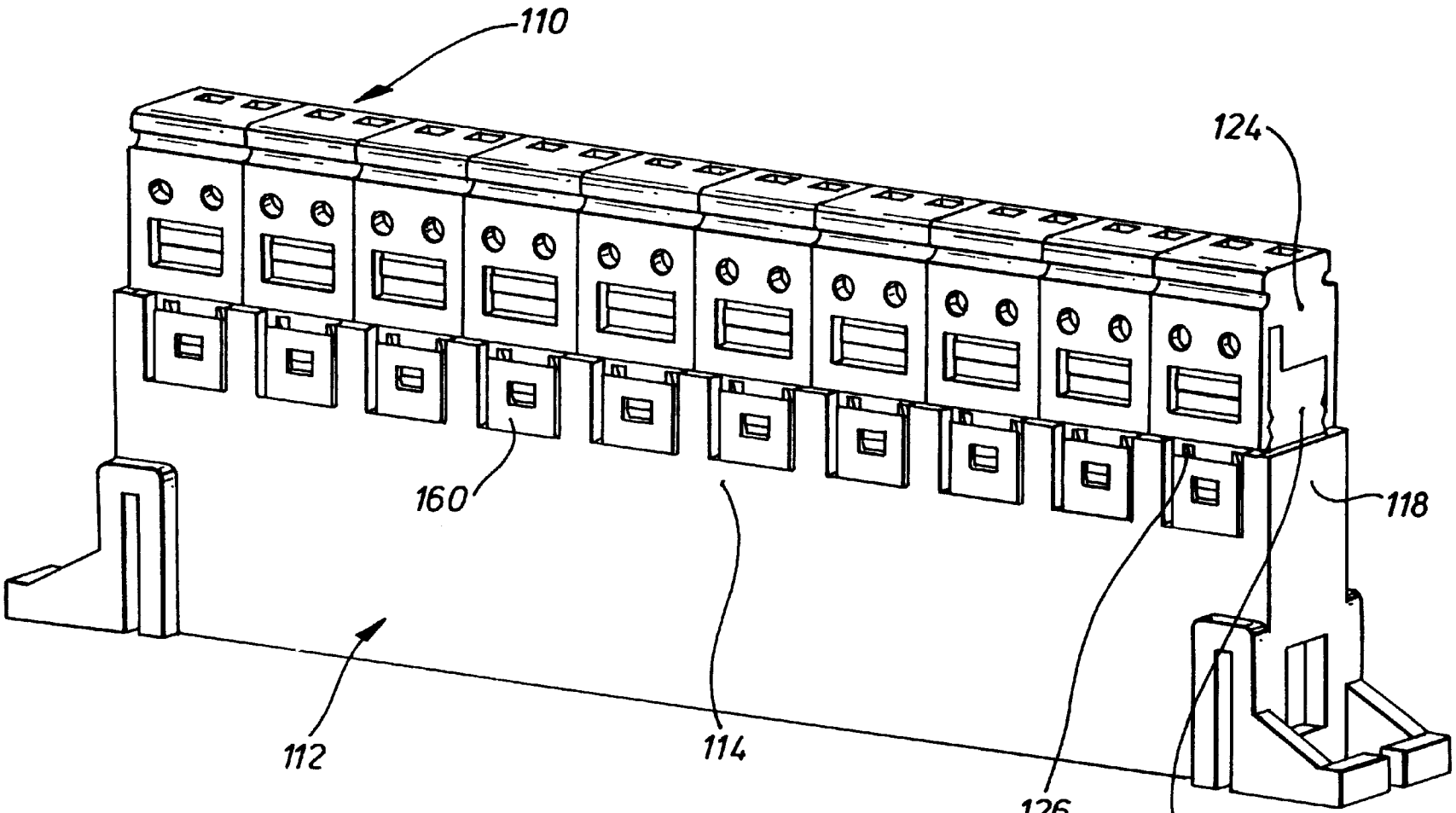
FIG. 5 is a perspective view of a group of connectors according to the second embodiment of the present invention.
Figure 8A:
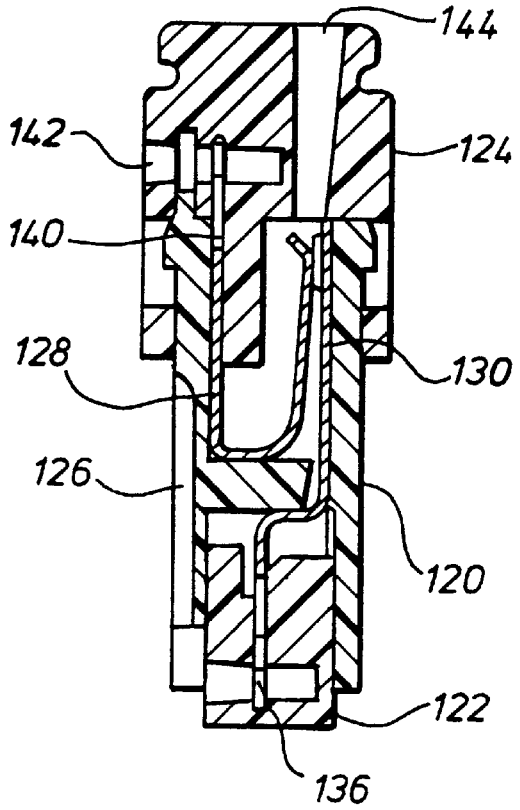
FIGS. 8*a* to 8*f* are sequential illustrations showing the action of connecting exchange and jumper wires to the connector of FIGS. 6 and 7, shown in section.
Figure 8B:
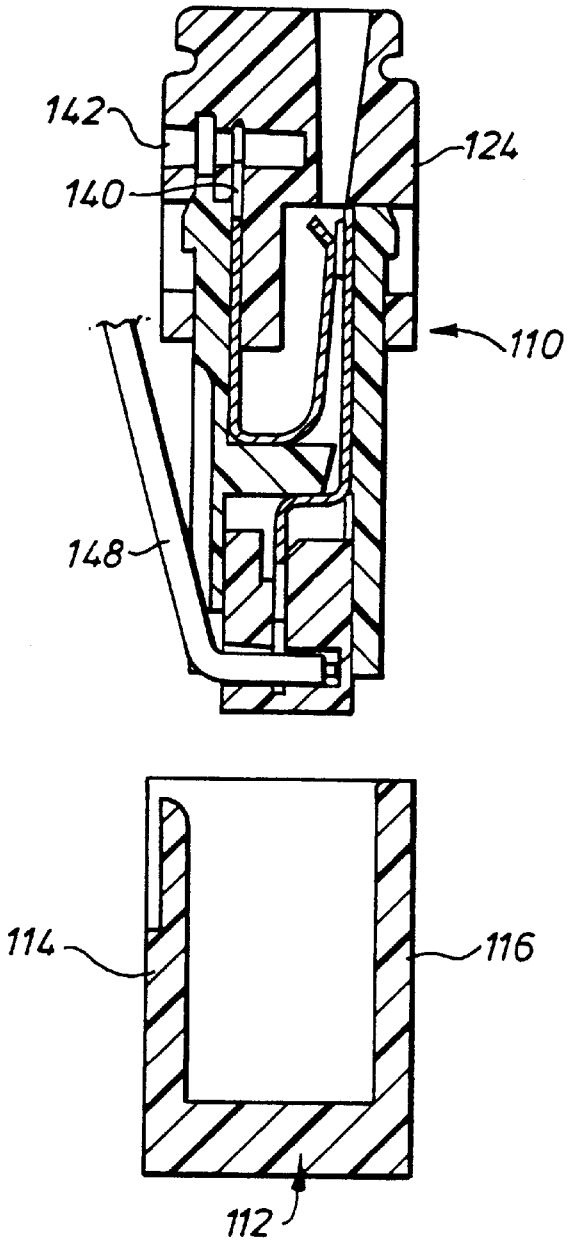
Figure 8C:
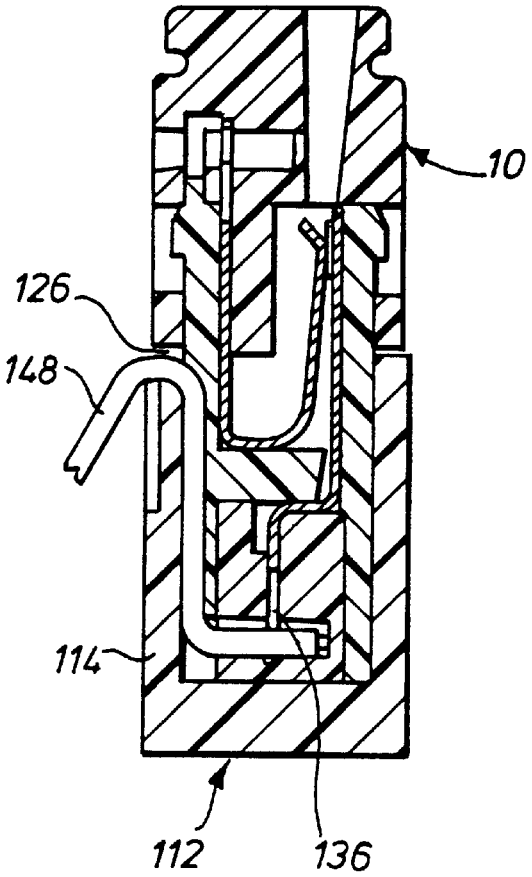
Figure 8D:
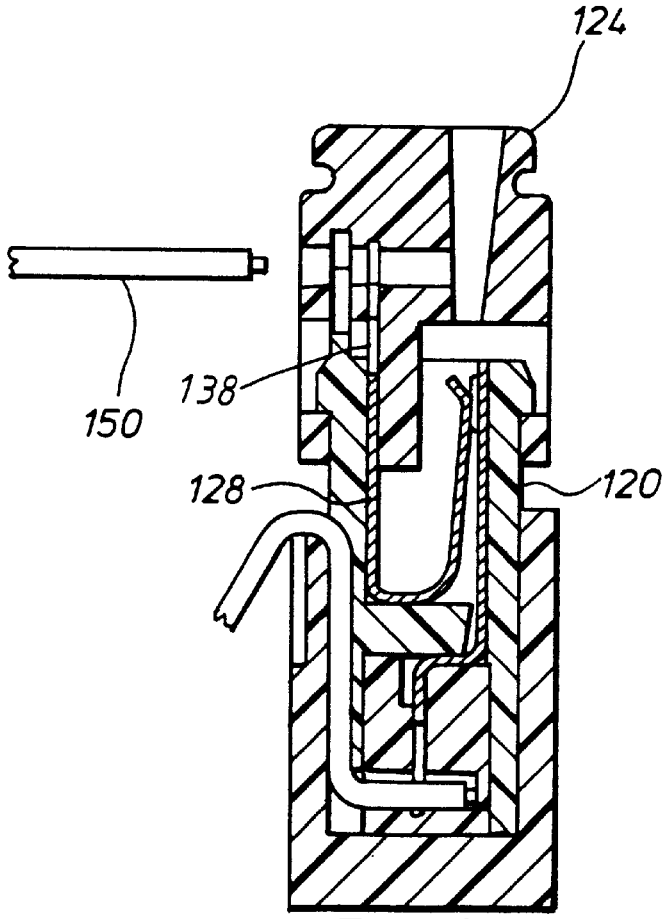
Figure 8E:
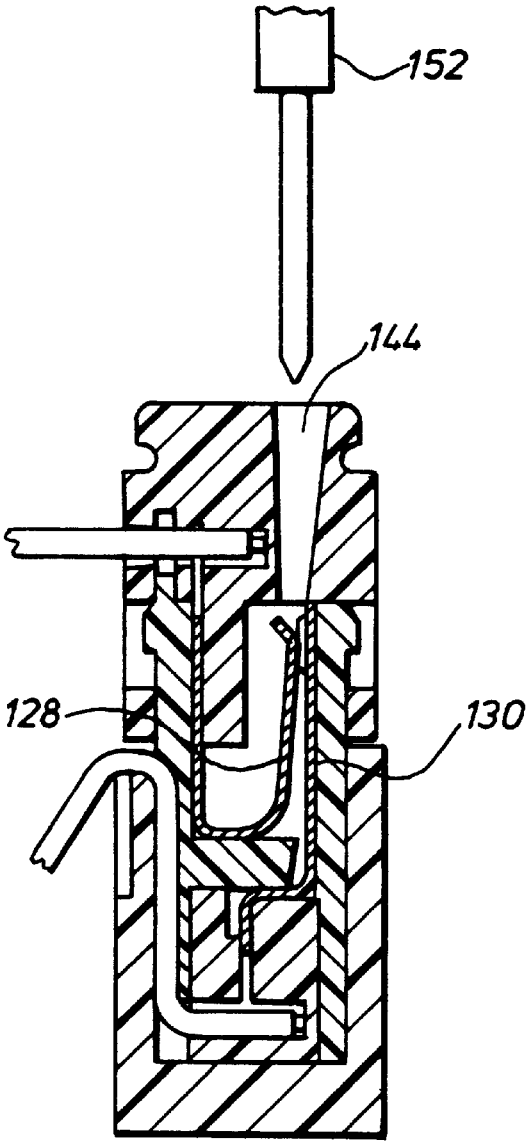
Figure 8F:
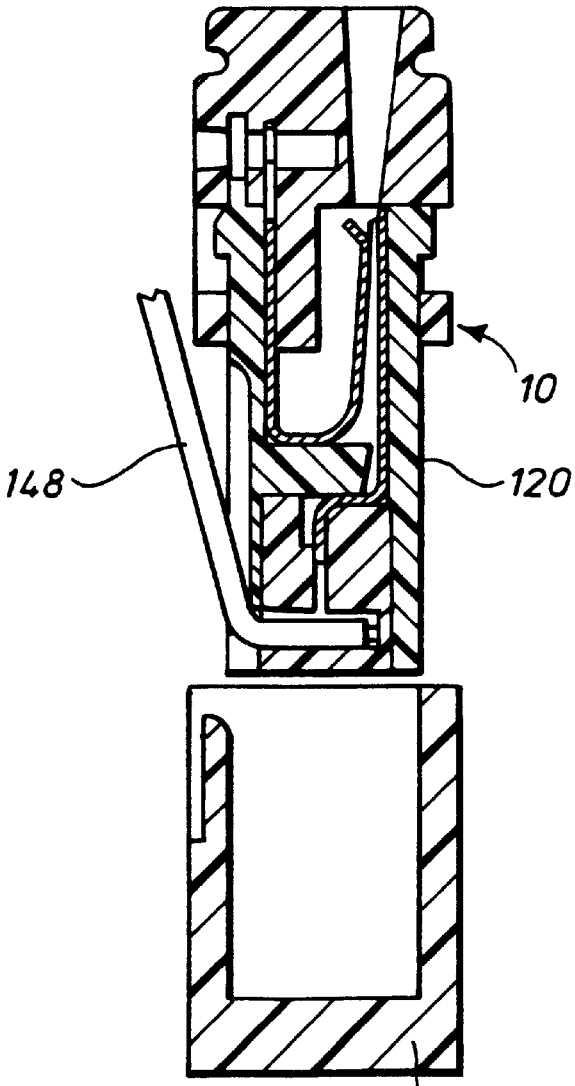

FIG. 5 shows an array of ten connector units 110 according to the second embodiment. The connectors 110 are supported in a base unit 112 in a single row of ten connectors. This layout is one commonly used in telephone exchanges. The connectors 110 are generally upright in configuration and are held in the base unit 112 between pairs of opposing walls, of which the front wall 114 is visible. Lateral displacement between the walls 114 is prevented by an end stop 118.

The connector unit 110 is prevented from an accidental removal from the base unit 2, by means of a latch 160. This latch 160 is resiliently held by the base unit 112 and engages on a lug 162, visible on FIG. 6 onwards.

FIGS. 6 to 8 shown the connector unit 110 in more detail. It can be seen that it is generally similar to the connector unit 10 shown in FIGS. 2 to 4, but differs most in the interaction between the main body part 120 and the head part 122. The body part 120 of the second embodiment shrouds the head part 122 on four sides, with cut-outs 164 at the base of the channels 126 to allow access to wire ports 166 in the head 122. The wire ports 126 are blind, and replace the channels 26*b* of FIG. 3.

The body part 120, as mentioned earlier, has a latch 162 for engagement with the catch 160 of the base unit 112. It also has a pair of indents 168 which engage with corresponding protrusions 170 on the cap 124 to hold the cap in either the open (FIG. 6*a*) or closed (FIG. 6*b*) position.

The jumper IDC contacts 128 however include a pair of barbs 172 on either side thereof. These engage with internal faces of the body cavity to provide resistance against displacement as the cap 124 is moved from the closed to open position.

The exchange IDC contacts 130 include a locally raised contact portion 174 which provides the contact portion to the jumper IDC connectors 128. This will usually provide a better electrical contact than a simple plane face as shown in FIG. 3.

Referring to FIGS. 8*a* to 8*f*, the above noted differences between the first and second embodiments do not generally affect the operation of connecting and disconnecting jumper and exchange wires. To overcome the latch 160 between the base unit 112 and the connector unit 110, a tension force is exerted on the exchange wires to disengage the connector unit 110 and remove it from the base unit 112, allowing disconnection of an exchange wire. This method of removal is particularly straightforward, with little risk of damage to the connector 110 and base 112. No tools are needed.

It will thus be appreciated that the present invention provides a connector unit with a particularly simple construction and few moving parts. At the same time, a versatile connector is provided which should be robust in use.

It will be appreciated by those skilled in the art that the above-described examples are for the purposes of illustration only, and that many variations thereto can be made whilst remaining in the scope of the present invention. For example, the dimensions and proportions can be altered to accommodate wires of different gauges. In addition, it will often be desirable to fill the internal spaces of the connector with known gels to protect the contacts and IDC tips from environmental degradation.

What is claimed is:

1. A connector apparatus, comprising a base unit and a connector module;

the base unit comprising a module receiving means, the module receiving means being for accepting the connector module;

the connector module including at least one IDC connector and a wire receiving means, the IDC connector being for making electrical connection with a wire; and the wire receiving means being for retention of said wire;

wherein the connector module is such that insertion thereof into the base unit causes the IDC connector to move relative to the wire receiving means thereby to make electrical connection between the IDC connector and a wire in the wire receiving means.

2. A connector apparatus according to claim 1 wherein the connector module comprises a head part, a body part, and a bore extending through both and containing the IDC connector, such that force applied to the head part such as to engage the connector unit within the base unit causes the head part to move relative to the body part and hence to move the IDC connector relative thereto.

3. A connector according to claim 1 wherein the wire receiving means is one selected from a bore and a channel leading to a bore, into which said bore or channel the IDC connector can extend.

4. A connector according to claim 2 wherein the wire receiving means is one selected from a bore and a channel leading to a bore, into which said bore or channel the IDC connector can extend.

5. A connector according to claim 4 wherein the IDC connector so extends only in certain relative positions of the head part and body part.

6. A connector according to claim 1 wherein the connector apparatus is such that tension on a wire engaged with the IDC connector causes the connector module to be removed from the base unit.

7. A connector according to claim 1 wherein a wire is held within the wire receiving means, said wire being an exchange wire of a telecommunications system.

8. A connector unit comprising a plug body, the plug body comprising a main body part and a head part, the main body and the head part being capable of mutual longitudinal displacement between a first position and a second position;

there being at least one channel formed on an external surface of at least the head part for receiving a wire, and at least one contact member having a portion within the main body part, a portion within the head part, and an insulation displacing tip;

wherein relative displacement of the main body and head parts from the first position to the second position causes the insulation displacing tip to move relative to the channel from a position in which electrical contact will not be made with a wire in the channel to one in which electrical contact will be made between a wire in the channel and the contact member, said electrical contact being made when appropriate by the insulation displacing tip.

9. A connector unit according to claim 8 wherein there are two channels and two connectors, one per channel, thereby to make contact with a pair of wires.

10. A connector unit according to claim 8 wherein, in the first position, the insulation displacing tip does not substantially project into the channel, and in the second position it does substantially project into the channel.

11. A connector unit according to claim 8 wherein the connector unit is associated with a base unit into which the plug body is insertable, thereby to at least partly cover the channel.

12. A connector unit according to claim 11 wherein insertion of the plug body into the base unit entirely encloses the head part.

13. A connector unit according to claim 11 wherein insertion of the plug body into the base unit partly covers the main body.

14. A connector unit according to claim 11 wherein the action of pressing the unit into the base causes mutual displacement of the head portion and main body portion thereby to cause electrical contact to be made between the connector and a wire within the channel.

15. A connector unit according to claim 8 wherein the channel runs over the head portion and partly onto the main body.

16. A connector unit according to claim 8 wherein the main body and the head slide relatively along the contact member.

* * * * *